United States Patent [19]

Kadija

[11] Patent Number: 4,544,474

[45] Date of Patent: Oct. 1, 1985

[54] POROUS DIAPHRAGMS FOR ELECTROLYTIC CELLS HAVING NON-UNIFORM HYDROPHOBICITY

[75] Inventor: Igor V. Kadija, Cleveland, Tenn.

[73] Assignee: Olin Corporation, Cheshire, Conn.

[21] Appl. No.: 637,099

[22] Filed: Aug. 2, 1984

Related U.S. Application Data

[62] Division of Ser. No. 332,424, Dec. 21, 1981, Pat. No. 4,468,360.

[51] Int. Cl.[4] ..... C25B 13/00

[52] U.S. Cl. ..... 204/295; 204/296

[58] Field of Search ..... 204/295, 296

[56] References Cited

U.S. PATENT DOCUMENTS

| | | | |
|---|---|---|---|
| 4,168,221 | 9/1979 | Kadija et al. | 204/252 |
| 4,184,939 | 1/1980 | Kadija | 204/252 |
| 4,207,163 | 6/1980 | Kadija | 204/253 |
| 4,216,072 | 8/1980 | Kadija | 204/252 |
| 4,238,303 | 12/1980 | Fang | 204/295 |
| 4,278,524 | 7/1981 | Kadija | 204/252 |

*Primary Examiner*—John F. Niebling

*Attorney, Agent, or Firm*—James B. Haglind; Donald F. Clements

[57] ABSTRACT

A porous diaphragm for an electrolytic cell for the electrolysis of alkali metal halides is comprised of a thermoplastic support fabric impregnated with particles of a siliceous composition. The thermoplastic support fabric has an anode side, a cathode side opposite the anode side, and a thickness of at least 0.3 millimeters. The cathode side has a greater hydrophobicity than the anode side. To provide greater hydrophobicity which results in controlled, reduced cell voltages, for example, the cathode side of the support fabric is treated with an oxidizing agent.

10 Claims, No Drawings

POROUS DIAPHRAGMS FOR ELECTROLYTIC CELLS HAVING NON-UNIFORM HYDROPHOBICITY

This is a division of application Ser. No. 332,424, filed Dec. 21, 1981, now U.S. Pat. No. 4,468,360.

This invention relates to diaphragm-type electrolytic cells for the electrolysis of aqueous salt solutions. More particularly, this invention relates to an improved porous diaphragm for an electrolytic cell.

For years commercial diaphragm cells have been used for the production of chlorine and alkali metal hydroxides such as sodium hydroxide which employed a deposited fiber diaphragm, usually of asbestos fibers. Porous asbestos diaphragms while satisfactory for producing chlorine and alkali metal hydroxide solutions, have a limited cell life and once removed from the cell, cannot be reused. Further, asbestos has now been identified by the Environmental Protection Agency of the U.S. Government as a health hazard.

One suitable replacement for deposited asbestos diaphragms is porous diaphragms comprised of a support fabric impregnated with particles of a siliceous component. These porous diaphragms are permeable to electrolytes such as alkali metal chloride brines, has increased cell life and can be removed from the cell and reinstalled in the cell respectively without requiring replacement.

U.S. Pat. No. 4,207,163, issued June 10, 1980, to I. V. Kadija describes porous diaphragms having support fabris produced from thermoplastic resins including polymers of olefins having from 2 to about 6 carbon atoms in the primary chain as well as their fluoro- and chloro- derivatives; and polyarylene compounds such as polyarylene sulfides. These thermoplastic resins, particularly chloro- and fluoro- polyolefins such as polytetrafluoroethylene, are known to be hydrophobic and have a low degree of wettability in aqueous solutions of electrolytes such as alkali metal chlorides.

As the thickness of the porous diaphragm increases, for example to greater than 0.3 millimeter, it has been found that during operation of the diaphragm cell there is a gradual increase in the cell voltage. This undesirable condition results in increased power costs and reduced efficiency.

It is an object of the present invention to provide an improved porous diaphragm having reduced energy requirements.

Another object of the present invention is to provide an electrolytic diaphragm cell employing thermoplastic fabric diaphragms having reduced energy requirements.

These and other objects of the invention are accomplished in a porous diaphragm for an electrolytic cell for the electrolysis of alkali metal halides comprised of a thermoplastic support fabric impregnated with particles of a siliceous composition, the thermoplastic support fabric having an anode side and a cathode side opposite the anode side and a thickness of at least 0.3 millimeter, the cathode side having a greater hydrophobicity than said anode side.

More in detail, the improved diaphragms of the present invention comprise a support fabric which is impregnated with the siliceous composition.

A support fabric is employed which is produced from materials which are chemically resistant to and dimensionally stable in the gases and electrolytes present in the electrolytic cell. The support fabric is substantially non-swelling, non-conducting and non-dissolving during operation of the electrolytic cell. The support fabric is also non-rigid and is sufficiently flexible to be shaped to the contour of an electrode, if desired.

Suitable support fabrics are those which can be handled easily without suffering physical damage. This includes handling before and after they have been impregnated with the siliceous component. Support fabrics employed can be removed from the cell following electrolysis, treated or repaired, if necessary, and replaced in the cell for further use without suffering substantial degradation or damage.

The support fabrics may be produced in any suitable manner. Suitable forms are those which promote absorption of the active component including sponge-like fabric forms. Preferred forms of support fabrics are felt fabrics, i.e., fabrics having a high degree of interfiber entanglement or interconnection which are usually non-woven. When employing felt as a support fabric, fluids passing through the fabric take a tortuous route through the randomly distributed, highly entangled fibers. The permeability of these fabrics is of a general nature, i.e., non-linear and non-controlled.

Support fabrics having uniform permeability throughout the fabric are quite suitable in diaphragms of the present invention. Prior to impregnation with the siliceous composition, these support fabrics should have a permeability to gases such as air of, for example, from about 5 to about 500, preferably from about 20 to about 200 and more preferably from about 30 to about 100 cubic feet per minute per square foot of fabric. Uniform permeability throughout the support fabric is not, however, required and it may be advantageous to have a greater permeability in one portion of the support fabric.

The thickness of the support fabric is suitably in the range of from about 0.3 to about 6, preferably from about 0.4 to about 5, and more preferably from about 0.5 to about 2 millimeters.

Materials which are suitable for use as support fabrics include thermoplastic materials such as polyolefins which are polymers of olefins having from about 2 to about 6 carbon atoms in the primary chain as well as their chloro- and fluoro- derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride and copolymers of ethylene-chloro-trifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Fabrics which are mixtures of fibers or polyolefins and fibers of polyarylene sulfides can be suitably used as well as layered support fabrics in which one layer is a polyolefin such as polytetrafluoroethylene and a second layer is a polyarylene sulfide such as polyphenylene sulfide.

The porous diaphragm is produced by impregnating the support fabric with a siliceous composition. Siliceous compositions suitable for use in porous diaphragms include silicates of magnesium, aluminum, or mixtures thereof. These compositions include magnesium-containing minerals such as sepiolites, meerschaums, augites, vermiculites, and talcs. Also suitable are synthetic silicates such as commercial magnesium silicates having the approximate composition $2MgO \cdot 3SiO_2 \cdot 2H_2O$.

Suitable siliceous compositions containing aluminum include montmorillonite clays such as bentonites, albites, feldspars, labradorites, microclines, nephelines, orthoclases, pyrophyllites, and sodalites; as well as natural and synthetic zeolites.

Porous diaphragms of the present invention may also be impregnated with mixtures of siliceous compositions of Mg or Al and inorganic metal oxides such as magnesium oxide, alumina, zirconium oxide, tin oxides, and antimony oxides.

Preferred siliceous compositions containing magnesium are sepiolite and meerschaums while montmorillonite clays are preferred as aluminum-containing silicates. Mixtures of magnesium oxide and montmorillonite clays are also preferred embodiments of siliceous compositions.

The support fabrics may be impregnated with the siliceous composition in any of several ways. For example, a slurry of the siliceous composition in an aqueous solution of an alkali metal hydroxide or an alkali metal chloride is prepared and the support fabric is impregnated by soaking in the slurry. Another method is to attach the supporting fabric to the cathode and immerse the cathode in the slurry, using the fabric as a filter cloth. Suction means are employed to draw the slurry through the support fabric where the solid particles impregnate the fabric and the filtrate is withdrawn.

In a further embodiment, the support fabric may be impregnated with the siliceous composition by employing means such as rollers to contact the support fabric with the slurry.

It is not necessary to employ a slurry for impregnation purposes. For example, particles of the siliceous composition may be used to form a fluidized bed. A vacuum is employed to suck the particles into the support fabric until the desired degree of impregnation is obtained.

When impregnated, the novel diaphragm of the present invention contains from about 10 to about 100, preferably from about 25 to about 75, and more preferably from about 30 to about 50 milligrams of the siliceous composition per square centimeter of support fabric.

Following impregnation with the siliceous composition, the porous diaphragms have a permeability to alkali metal chloride brines of from about 100 to about 1000, and preferably from about 200 to about 500 milliliters per minute per square meter of diaphragm at a head level difference between the anolyte and the catholyte of from about 0.1 to about 20 inches of brine.

The novel diaphragms of the present invention have handling properties which far exceed those of, for example, asbestos. The supported diaphragms can be removed from the cell, washed or treated to restore flowability and replaced in the cell without physical damage. During operation of the cell, the novel diaphragms remain dimensionally stable with the support material neither swelling nor being dissolved or deteriorated by the electrolyte, the siliceous composition or the cell products produced.

During operation of an electrolytic cell employing porous diaphragms comprised of thermoplastic support fabrics impregnated with siliceous components, it has been found that there is a gradual increase in the cell voltage. Surprisingly, it has been found that the cell can be operated at substantially constant cell voltages by employing the improved porous diaphragms of the present invention in which one side of the porous diaphragm is more hydrophobic than the other side. The side which is more hydrophobic is that which faces the cathodes.

To provide porous diaphragms having a greater hydrophobicity on the cathode side, in one embodiment, the side of the support fabric which will face the cathode is treated with an oxidizing agent. Suitable oxidizing agents include, for example, halogens such as chlorine or bromine, as well as aqueous solutions of oxy-halogen compounds such as alkali metal hypochlorites, alkali metal hypobromites, alkaline earth metal hypochlorites, alkaline earth metal hypobromites, hypochlorous acid, hypobromous acid, alkali metal chlorites, alkali metal bromites, alkali metal chlorates, alkaline earth metal chlorates, alkaline earth metal bromates, alkali metal bromates, alkali metal perchlorates, and alkaline earth metal perchlorates. The alkali metals of the oxy-halogen compounds include sodium and potassium and the alkaline earth metals are, for example, calcium and magnesium.

Other suitable oxidizing agents include hydrogen peroxide, oxygen-containing gases such as oxygen or air, and acids such as nitric acid.

Preferred as oxidizing agents are chlorine and oxychlorine compounds.

To increase the hydrophobicity of the cathode side of the support fabric, the support fabric is treated with the oxidizing agent to oxidize the surface of the fabric. This oxidation process is believed to remove surface coatings applied to the fabric during its manufacture.

In another embodiment, hydrophobicity of the side of the porous diaphragm to face the anode is reduced by treatment with a metal oxide, for example, an alkaline earth metal oxide such as magnesium oxide.

In a further embodiment, the hydrophobicity of the side of the porous diaphragm facing the anode is reduced when coated with fluoroalkyl esters of unsaturated acids such as acrylic acid or methacrylic acid where the fluoroalkyl groups have from about 3 to about 15 carbon atoms. The fluoroalkyl esters are commercially available as water repellents and include fluorochemical resins sold under the tradename "Asahi Guard" ® by the Asahi Glass Company and "Scotchguard" ® by the 3M Company. Suitable examples of the fluoroalkyl esters include:

$CF_3(CF_2)_4CH_2OCOC(CH_3)=CH_2$,
$(CF_3)_2CF(CF_2)_6(CH_2)_3OCOCH=CH_2$,
$(CF_3)_2CF(CF_2)_9(CH_2)_3OCOCH=CH_2$,
$CF_3(CF_2)_6(CH_2)_2OCOC(CH_3)=CH_2$
$(CF_3)_2CF(CF_2)_6(CH_2)_2OCOCH=CH_2$,
$CF_3(CF_2)_7SO_2N(C_3H_7)(CH_2)_2OCOCH=CH_2$,
$CF_3(CF_2)_7(CH_2)_4OCOCH=CH_2$, $CF_3(CF_2)_7SO_2N(CH_3)(CH_2)_2OCOC(CH_3)=CH_2$,
$CF_3(CF_2)_7(CH_2)_3COOCH=CH_2$,
$(CF_3)_2CF(CF_2)_6CH_2CH(OH)CH_2OCOCH=CH_2$,
$(CF_3)_2CF(CF_2)_6CH_2CH(OCOCH_3)OCOC(CH_3)=CH_2$,
$CF_2ClCF_3CF(CF_2)_7CONHCOOCH=CH_2$,
$H(CF_2)_{10}CH_2OCOCH=CH_2$, and
$CF_2Cl(CF_2)_{10}CH_2OCOC(CH_3)=CH_2$.

In an additional embodiment, a layered porous diaphragm having a greater hydrophobicity on the cathode side is produced where a first section facing the anode is comprised of a fabric which is predominantly, for example, from about 30 to about 100 percent; a polyarylene compound such as polyphenylene sulfide; and a second section facing the cathode fabric which is comprised of a fabric which is predominantly, for example, from about 70 to about 100 percent of polyolefin such as polytetrafluoroethylene.

In each of the embodiments disclosed above, the portion of the porous diaphragm facing the cathode is more hydrophobic than the portion facing the anode. To determine hydrophobicity, for example, in one method the water contact angle is measured by the method and apparatus described on page 137 of "Contact Angle, Wettability and Adhesion", *American Chemical Society* 1964. For example, the water contact angle of a support fabric of a polytetrafluoroethylene felt initially in the range of 60° to 90° is increased from about 100° to about 120° when treated on one side with an oxidizing agent such as sodium hypochlorite. This increase in water contact angle indicates the treated side of the porous diaphragm has increased in hydrophobicity. In order to maintain the desired cell voltage levels, the difference in water contact angles between the side of the porous diaphragm facing the anode and that of the side facing the cathode be in the range of from about 10° to about 90°, preferably from about 15° to about 70°, and more preferably from about 30° to about 60°.

In a second method for determining hydrophobicity, a drop of water is placed on the surface of the porous diaphragm and the time determined for its adsorption.

While not wishing to be bound by theory, it is believed that the improved porous diaphragms of the present invention prevent or substantially reduce the nucleation and formation of hydrogen gas or water vapor bubbles within the interior portion of the porous diaphragm. The formation and accumulation of gas bubbles within the porous diaphragm is believed to result in increased electrical resistance and thus increases the voltage required to operate the electrolysis process. By employing the novel diaphragms of the present invention in which the cathode side has a greater hydrophobicity than the anode side, it is believed that gas bubbles nucleate on the cathode side and are readily released.

Electrolytic cells in which the diaphragms of the present invention may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal or graphite anodes, a cathode assembly having a plurality of foraminous metal cathodes with the novel diaphragm separating the anodes from the cathodes. Suitable electrolytic cells which utilize the novel diaphragms of the present invention include, for example, those types illustrated by U.S. Pat. Nos. 1,862,244; 2,370,087; 2,987,463; 3,247,090; 3,477,938; 3,493,487; 3,617,461 and 3,642,604.

The improved porous diaphragms of the present invention are illustrated by the following examples without any intention of being limited thereby.

EXAMPLE 1

A polytetrafluoroethylene felt fabric (4.2 mm thick, 620 grams per square meter) was installed in a vacuum vessel with one side of the felt in contact with a steel mesh cathode. Sepiolite particles were added to an aqueous sodium chloride solution to form a slurry containing about 5 percent by volume of sepiolite. The slurry was added to the cell and a vacuum was applied from the cathode side to impregnate the support fabric with sepiolite particles. The impregnated support fabric and the cathode were installed in an electrolytic cell having a ruthenium oxide-coated titanium anode and sodium chloride brine (319 grams NaCl per liter. Electrolysis was conducted for about 30 hours at a current density of 2 $KA/m^2$ under conditions where the concentration of the NaOH formed allowed significant amounts of hypochlorite ion and chlorate ion to be produced by back migration of hydroxyl ions. During the electrolysis, the side of the porous diaphragm facing the anode and in contact with the anolyte was oxidized by the chlorine gas, hypochlorite ions and chlorate ions produced. Cell operation was discontinued and the porous diaphragm removed from the cell. The porous diaphragm was reinstalled in the electrolytic cell with the oxidized side of the porous diaphragm placed in contact with the cathode. The cell was operated to electrolyze NaCl brine (319 grams per liter) at a current density of 2.33 $KA/m^2$ and a cell voltage of 3.66–3.70 for a period of 30 days. During this period, the cell voltage remained substantially constant.

COMPARATIVE EXAMPLE A

A polytetrafluoroethylene felt fabric identical to that used in EXAMPLE 1 was impregnated with sepiolite particles and installed in the electrolytic cell of EXAMPLE 1. Electrolyzing sodium chloride brine (320 gpl) at a current density of 2.33 $KA/m^2$, the cell voltage was initially 3.6 volts. During operation of the cell, the cell voltage increased at a rate of 30 to 50 millivolts per day. To reduce the cell voltage, the diaphragm was flushed out every 2 to 4 weeks by shutting down the cell and increasing the flow rate of feed brine to the maximum flow rate which removed $H_2$ and water vapor gas bubbles from the interior of the diaphragm.

Using the novel diaphragm of EXAMPLE 1 having an oxidized side of the diaphragm with greater hydrophobicity in contact with the cathode, the cell was operated at a constant voltage. The cell of COMPARATIVE EXAMPLE A, having a diaphragm of uniform hydrophobicity and untreated by oxidation of the cathode side, had an ever increasing cell voltage during operation which required frequent shutdowns and flushing operations to reduce the cell voltage to a suitable level.

EXAMPLE 2

A two layered support fabric was formed by needling a polytetrafluoroethylene felt fabric (150 grams per square meter) onto a porous polytetrafluoroethylene fabric (Goretex® monofilament scrim, 117 grams per square meter). The support fabric was immersed in a slurry of cell liquor containing 30 percent by weight of magnesium oxide particles. A roller was used to impregnate the felt side of the support fabric with MgO, but the roller was not applied to the porous fabric. The diaphragm was removed from the slurry and air dried. After drying, the support fabric was immersed again in the slurry and the MgO treatment repeated. Hydrophobicity of the dried treated support fabric was determined by placing a drop of water on the surface of the side of the support fabric treated with MgO. The drop was adsorbed instantly. A drop of water placed on the untreated monofilament scrim side of the support fabric remained unadsorbed for a period of about 15 minutes. The support fabric was installed in a cell with the untreated monofilament scrim fabric in contact with a steel mesh cathode and the MgO treated felt facing the ruthenium oxidecoated titanium anode. The cell was filled with a slurry of bentonite particles (60 ml) and MgO (10 ml) per 1.5 liters of sodium chloride brine (315 grams NaCl per liter). A vacuum was applied from the cathode side and the support fabric impregnated with bentonite particles. Electric current was fed to the cell at a current density of 2KA and electrolysis of the sodium chloride conducted. The initial cell voltage was 3.3 volts. After 30 days, the cell voltage had been reduced to 3.05 volts and the cell voltage remained at this level for the next 60 days.

What is claimed is:

1. A porous diaphragm for an electrolytic cell for the electrolysis of alkali metal halides comprised of a thermoplastic support fabric impregnated with particles of a siliceous composition, said thermoplastic support fabric having an anode side, a cathode side opposite said anode side, and a thickness of at least 0.3 millimeters, said cathode side having a greater hydrophobicity than said anode side.

2. The porous diaphragm of claim 1 in which the water contact angle at said cathode side is greater than the water contact angle at said anode side by an amount in the range of from about 10° to about 90°.

3. The porous diaphragm of claim 2 in which said siliceous composition is present at a concentration of from about 10 to about 100 milligrams per square centimeter of said support fabric.

4. The porous diaphragm of claim 3 in which said support fabric is a polyolefin selected from the group consisting of olefins having from 2 to about 6 carbon atoms and their cloro- and fluoro- derivatives.

5. The porous diaphragm of claim 4 in which said support fabric is a polyolefin selected from the group consisting of polypropylene, polytetrafluoroethylene, fluorinated ethylene-propylene, polychlorotrifluoroethylene, polyvinyl fluoride and polyvinylidene fluoride.

6. The porous diaphragm of claim 5 in which said support fabric is selected from the group consisting of polytetrafluoroethylene and polyvinylidene fluoride.

7. The porous diaphragm of claim 6 in which said siliceous composition is selected from the group consisting of sepiolites and meerschaums.

8. The porous diaphragm of claim 7 in which said siliceous composition is bentonite.

9. The porous diaphragm of claim 7 or claim 8 in which said water contact angle at the cathode side is greater than said water contact angle at said anode side by an amount of from about 30° to about 60°.

10. A porous diaphragm for an electrolytic cell for the electrolysis of alkali metal halides comprised of a thermoplastic support fabric impregnated with particles of a siliceous composition, said thermoplastic support fabric having an anode side, a cathode side opposite said anode side, and a thickness of at least 0.3 millimeters, said cathode side having been treated with an oxidizing agent to provide greater hydrophobicity than that of said anode side of said porous diaphragm.

* * * * *